US009929485B2

(12) United States Patent
Jandt et al.

(10) Patent No.: US 9,929,485 B2
(45) Date of Patent: Mar. 27, 2018

(54) CARD EDGE CONNECTOR USING A SET OF ELECTROACTIVE POLYMERS

(71) Applicant: International Business Machines Corporation, Armonk, NY (US)

(72) Inventors: Tyler Jandt, Rochester, MN (US); Phillip V. Mann, Rochester, MN (US); Mark D. Plucinski, Rochester, MN (US); Sandra J. Shirk/Heath, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/940,111

(22) Filed: Nov. 12, 2015

(65) Prior Publication Data

US 2017/0141497 A1 May 18, 2017

(51) Int. Cl.
*H01R 24/00* (2011.01)
*H01R 12/72* (2011.01)

(52) U.S. Cl.
CPC ..... *H01R 12/721* (2013.01)

(58) Field of Classification Search
CPC H01R 13/193; H01R 23/684; H01R 23/6833; H01R 23/6846; H01R 23/7068; H05K 7/1023
USPC ..... 439/259, 260, 263, 266, 267, 635, 637
See application file for complete search history.

(56) References Cited

U.S. PATENT DOCUMENTS 4,863,395 A 9/1989 Babuka et al.
4,904,197 A * 2/1990 Cabourne ..... H01R 12/89 439/260
5,059,133 A 10/1991 Hikami et al.
5,679,018 A * 10/1997 Lopata ..... H01R 12/716 439/260
6,376,971 B1 4/2002 Pelrine et al.
6,572,396 B1 * 6/2003 Rathburn ..... H01R 12/89 439/260
6,855,009 B2 2/2005 Nishiyama
(Continued)

FOREIGN PATENT DOCUMENTS

WO WO2014089388 A2 6/2014
WO WO2015107376 A1 7/2015

OTHER PUBLICATIONS

Jandt et al., "Card Edge Connector Using a Set of Electroactive Polymers", U.S. Appl. No. 15/055,588, filed Feb. 27, 2016.
List of IBM Patents or Patent Applications Treated As Related.

*Primary Examiner* — Thanh Tam Le
(74) *Attorney, Agent, or Firm* — Nicholas D. Bowman

(57) ABSTRACT

Disclosed aspects include an apparatus having a card edge connector which has first and second positions. The apparatus may include a set of contacts to connect with a set of card edges in the second position. To adjust the set of contacts between the first position and the second position, the apparatus may include a set of electroactive polymers. Disclosed aspects include card edge connector management. It may be detected that a card edge connector is in a first position. A request for the card edge connector to be in a second position can be received. It is determined to adjust the card edge connector. The card edge connector is adjusted using a set of electroactive polymers. In embodiments, such adjustment can include introducing a voltage which causes the set of electroactive polymers to adjust a set of contacts between the first and second positions.

9 Claims, 5 Drawing Sheets

(56) References Cited

U.S. PATENT DOCUMENTS

| | | | | |
|---|---|---|---|---|
| 7,014,487 | B2 * | 3/2006 | Ishikawa | H01R 13/055 439/267 |
| 7,390,208 | B1 * | 6/2008 | Sabo | H01R 12/57 439/260 |
| 7,438,578 | B1 * | 10/2008 | Nin | H01R 12/89 439/260 |
| 7,456,365 | B2 | 11/2008 | Gilliland et al. | |
| 7,659,483 | B2 | 2/2010 | Gilliland et al. | |
| 7,682,157 | B2 | 3/2010 | Wang et al. | |
| 8,152,775 | B2 | 4/2012 | Desantis et al. | |
| 8,718,313 | B2 | 5/2014 | Keady | |
| 8,905,773 | B2 * | 12/2014 | Liang | H01R 12/87 439/260 |
| 9,559,445 | B2 | 1/2017 | Wig | |
| 2010/0229610 | A1 | 9/2010 | Garrigan et al. | |
| 2014/0072771 | A1 | 3/2014 | Xie et al. | |

* cited by examiner

CARD EDGE CONNECTOR USING A SET OF ELECTROACTIVE POLYMERS

BACKGROUND

This disclosure relates generally to electronic components of computer systems and, more particularly, relates to a card edge connector. Electronics enclosures, such as those used in computer systems, can contain numerous electronic components, such as video cards and sound cards. Methodologies for retention of the electronic components in the electronics enclosure can involve large loading hardware and non-influencing fasteners. Such devices may have one or two positions (e.g., an undocked and docked position) that require manual operation. Also, expensive and disposable shipping brackets can be used to mitigate connector wear when the enclosure is shipped.

SUMMARY

Aspects of the disclosure use a set of electroactive polymers (EAPs) to dynamically adjust a card opening in a card edge connector. As such, aspects may positively impact card edge connector wear, plug forces, and surface-mount technology (SMT) strain from over-docking. Aspects can accommodate multiple card thicknesses and may positively impact proper seating of the card. In embodiments, aspects can be used to provide mechanical retention to the card. In certain embodiments, aspects can be applied to zero insertion force (ZIF) cable connectors to improve the design by eliminating the small, often inaccessible latch mechanisms and prevent cable damage.

Disclosed aspects include an apparatus having a card edge connector. The card edge connector may have a first position and a second position. The apparatus may include a set of contacts. The set of contacts may be included to connect with a set of card edges in the second position. Such connection may occur at both a first contact location and a second contact location. The first distance between the first and second contact locations in the first position can exceed a second distance between the first and second contact locations in the second position. To adjust the set of contacts between the first position and the second position, the apparatus may include a set of electroactive polymers.

Disclosed aspects include card edge connector management. A computer-based system/device may detect that a card edge connector is in a first position. A request for the card edge connector to be in a second position can be received. By comparing the first position and the second position, it is determined to adjust the card edge connector. The card edge connector is adjusted using a set of electroactive polymers. In embodiments, such adjustment can include introducing a voltage which causes the set of electroactive polymers to adjust a set of contacts between the first position and the second position.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
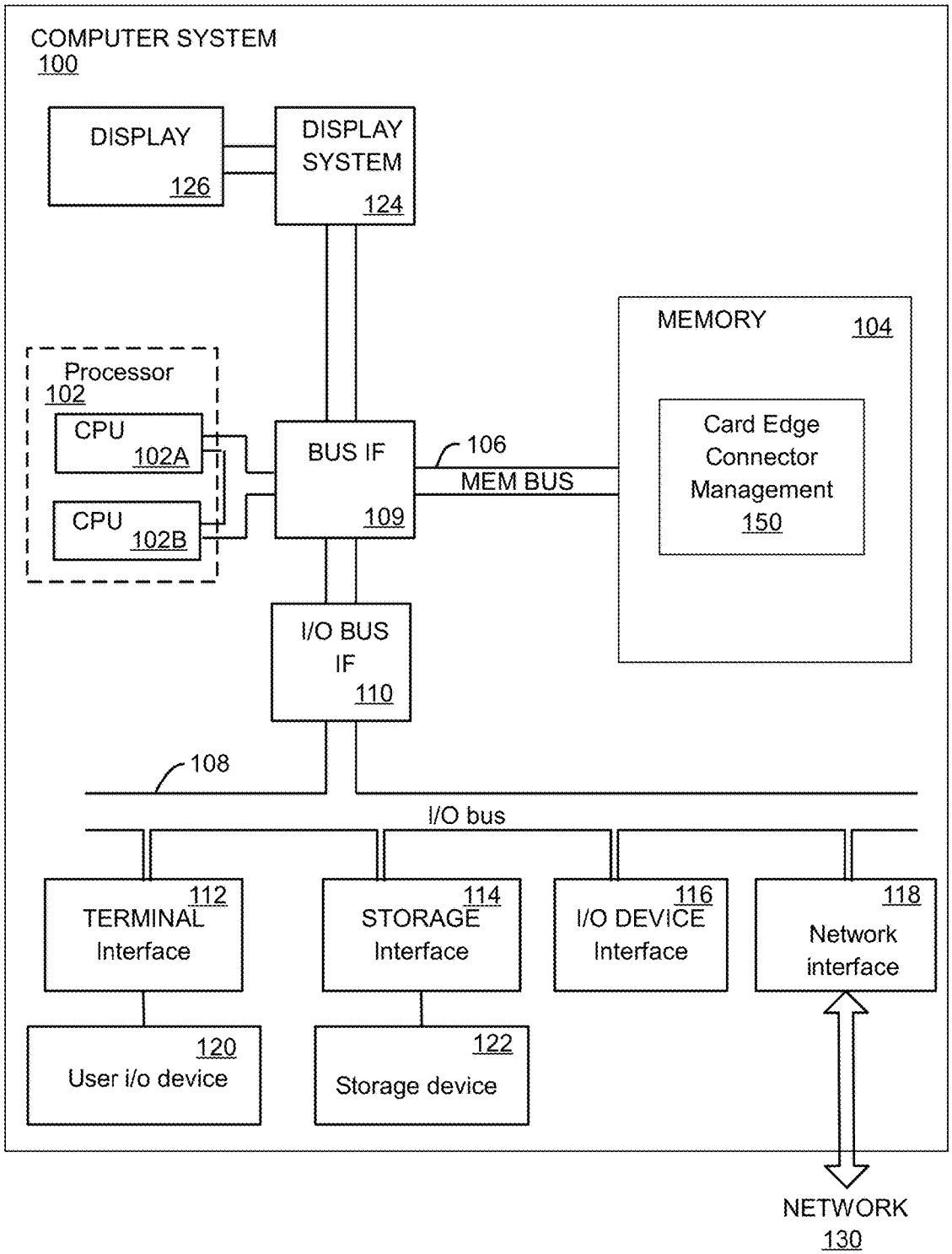
FIG. 1 depicts a high-level block diagram of a computer system for implementing various embodiments of the present disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the disclosure use a set of electroactive polymers (EAPs) to dynamically adjust a card opening in a card edge connector. As such, aspects may positively impact card edge connector wear, plug forces, and surface-mount technology (SMT) strain from over-docking. Aspects can accommodate multiple card thicknesses and may positively impact proper seating of the card. In embodiments, aspects can be used to provide mechanical retention to the card. In certain embodiments, aspects can be applied to zero insertion force (ZIF) cable connectors to improve the design by eliminating the small, often inaccessible latch mechanisms and prevent cable damage.

Aspects of the disclosure include a system or an apparatus which may have an electronic component. The electronic component can include a card edge connector. The card edge connector may have a first position and a second position. The apparatus may include a set of contacts. The set of contacts may be included to connect with a set of card edges in the second position. Such connection may occur at both a first contact location and a second contact location. The first distance between the first and second contact locations in the first position can exceed a second distance between the first and second contact locations in the second position. To adjust the set of contacts between the first position and the second position, the apparatus may include a set of electroactive polymers.

In embodiments, the set of electroactive polymers may be associated with a voltage which causes the set of electroactive polymers to adjust the set of contacts between the first position and the second position. In various embodiments, a set of insulators may be located between the set of contacts and the set of electroactive polymers. In certain embodiments, the set of contacts includes a set of pins which are bent in the second position relative to the first position. The set of electroactive polymers can be located internal or external with respect to a housing.

Aspects of the disclosure include a system, a computer program product, or a method for managing an electronic component such as the card edge connector. A computer-based system/device may detect that the card edge connector is in a first position. A request for the card edge connector to be in a second position can be received. By comparing the first position and the second position, it is determined to adjust the card edge connector. The card edge connector is adjusted using a set of electroactive polymers. In embodiments, such adjustment can include introducing a voltage which causes the set of electroactive polymers to adjust a set of contacts between the first position and the second position. Altogether, aspects of the disclosure may have performance or efficiency benefits (e.g., security, wear, force application, service-length, connection quality).

Turning now to the figures, FIG. 1 depicts a high-level block diagram of a computer system for implementing various embodiments of the present disclosure, consistent with various embodiments. The mechanisms and apparatus of the various embodiments disclosed herein apply equally to any appropriate computing system. The major components of the computer system 100 include one or more processors 102, a memory 104, a terminal interface 112, a storage interface 114, an I/O (Input/Output) device interface 116, and a network interface 118, all of which are communicatively coupled, directly or indirectly, for inter-component communication via a memory bus 106, an I/O bus 108, bus interface unit 109, and an I/O bus interface unit 110.

The computer system 100 may contain one or more general-purpose programmable central processing units (CPUs) 102A and 102B, herein generically referred to as the processor 102. In embodiments, the computer system 100 may contain multiple processors; however, in certain embodiments, the computer system 100 may alternatively be a single CPU system. Each processor 102 executes instructions stored in the memory 104 and may include one or more levels of on-board cache.

In embodiments, the memory 104 may include a random-access semiconductor memory, storage device, or storage medium (either volatile or non-volatile) for storing or encoding data and programs. In certain embodiments, the memory 104 represents the entire virtual memory of the computer system 100, and may also include the virtual memory of other computer systems coupled to the computer system 100 or connected via a network. The memory 104 can be conceptually viewed as a single monolithic entity, but in other embodiments the memory 104 is a more complex arrangement, such as a hierarchy of caches and other memory devices. For example, memory may exist in multiple levels of caches, and these caches may be further divided by function, so that one cache holds instructions while another holds non-instruction data, which is used by the processor or processors. Memory may be further distributed and associated with different CPUs or sets of CPUs, as is known in any of various so-called non-uniform memory access (NUMA) computer architectures.

The memory 104 may store all or a portion of the various programs, modules and data structures for processing data transfers as discussed herein. For instance, the memory 104 can store a card edge connector management application 150. In embodiments, the card edge connector management application 150 may include instructions or statements that execute on the processor 102 or instructions or statements that are interpreted by instructions or statements that execute on the processor 102 to carry out the functions as further described below. In certain embodiments, the card edge connector management application 150 is implemented in hardware via semiconductor devices, chips, logical gates, circuits, circuit cards, and/or other physical hardware devices in lieu of, or in addition to, a processor-based system. In embodiments, the card edge connector management application 150 may include data in addition to instructions or statements.

The computer system 100 may include a bus interface unit 109 to handle communications among the processor 102, the memory 104, a display system 124, and the I/O bus interface unit 110. The I/O bus interface unit 110 may be coupled with the I/O bus 108 for transferring data to and from the various I/O units. The I/O bus interface unit 110 communicates with multiple I/O interface units 112, 114, 116, and 118, which are also known as I/O processors (IOPs) or I/O adapters (IOAs), through the I/O bus 108. The display system 124 may include a display controller, a display memory, or both. The display controller may provide video, audio, or both types of data to a display device 126. The display memory may be a dedicated memory for buffering video data. The display system 124 may be coupled with a display device 126, such as a standalone display screen, computer monitor, television, or a tablet or handheld device display. In one embodiment, the display device 126 may include one or more speakers for rendering audio. Alternatively, one or more speakers for rendering audio may be coupled with an I/O interface unit. In alternate embodiments, one or more of the functions provided by the display system 124 may be on board an integrated circuit that also includes the processor 102. In addition, one or more of the functions provided by the bus interface unit 109 may be on board an integrated circuit that also includes the processor 102.

The I/O interface units support communication with a variety of storage and I/O devices. For example, the terminal interface unit 112 supports the attachment of one or more user I/O devices 120, which may include user output devices (such as a video display device, speaker, and/or television set) and user input devices (such as a keyboard, mouse, keypad, touchpad, trackball, buttons, light pen, or other pointing device). A user may manipulate the user input devices using a user interface, in order to provide input data and commands to the user I/O device 120 and the computer system 100, and may receive output data via the user output devices. For example, a user interface may be presented via the user I/O device 120, such as displayed on a display device, played via a speaker, or printed via a printer.

The storage interface 114 supports the attachment of one or more disk drives or direct access storage devices 122 (which are typically rotating magnetic disk drive storage devices, although they could alternatively be other storage devices, including arrays of disk drives configured to appear as a single large storage device to a host computer, or solid-state drives, such as flash memory). In some embodiments, the storage device 122 may be implemented via any type of secondary storage device. The contents of the memory 104, or any portion thereof, may be stored to and retrieved from the storage device 122 as needed. The I/O device interface 116 provides an interface to any of various other I/O devices or devices of other types, such as printers or fax machines. The network interface 118 provides one or more communication paths from the computer system 100 to other digital devices and computer systems; these communication paths may include, e.g., one or more networks 130.

Although the computer system 100 shown in FIG. 1 illustrates a particular bus structure providing a direct communication path among the processors 102, the memory 104, the bus interface 109, the display system 124, and the I/O bus interface unit 110, in alternative embodiments the computer system 100 may include different buses or communication paths, which may be arranged in any of various forms, such as point-to-point links in hierarchical, star or web configurations, multiple hierarchical buses, parallel and redundant paths, or any other appropriate type of configuration. Furthermore, while the I/O bus interface unit 110 and the I/O bus 108 are shown as single respective units, the computer system 100 may, in fact, contain multiple I/O bus interface units 110 and/or multiple I/O buses 108. While multiple I/O interface units are shown, which separate the I/O bus 108 from various communications paths running to the various I/O devices, in other embodiments, some or all of the I/O devices are connected directly to one or more system I/O buses.

In various embodiments, the computer system 100 is a multi-user mainframe computer system, a single-user system, or a server computer or similar device that has little or no direct user interface, but receives requests from other computer systems (clients). In other embodiments, the computer system 100 may be implemented as a desktop computer, portable computer, laptop or notebook computer, tablet computer, pocket computer, telephone, smart phone, or any other suitable type of electronic device.

FIG. 1 depicts several major components of the computer system 100. Individual components, however, may have greater complexity than represented in FIG. 1, components other than or in addition to those shown in FIG. 1 may be present, and the number, type, and configuration of such components may vary. Several particular examples of additional complexity or additional variations are disclosed herein; these are by way of example only and are not necessarily the only such variations. The various program components illustrated in FIG. 1 may be implemented, in various embodiments, in a number of different manners, including using various computer applications, routines, components, programs, objects, modules, data structures, etc., which may be referred to herein as "software," "computer programs," or simply "programs."

Figure 2:
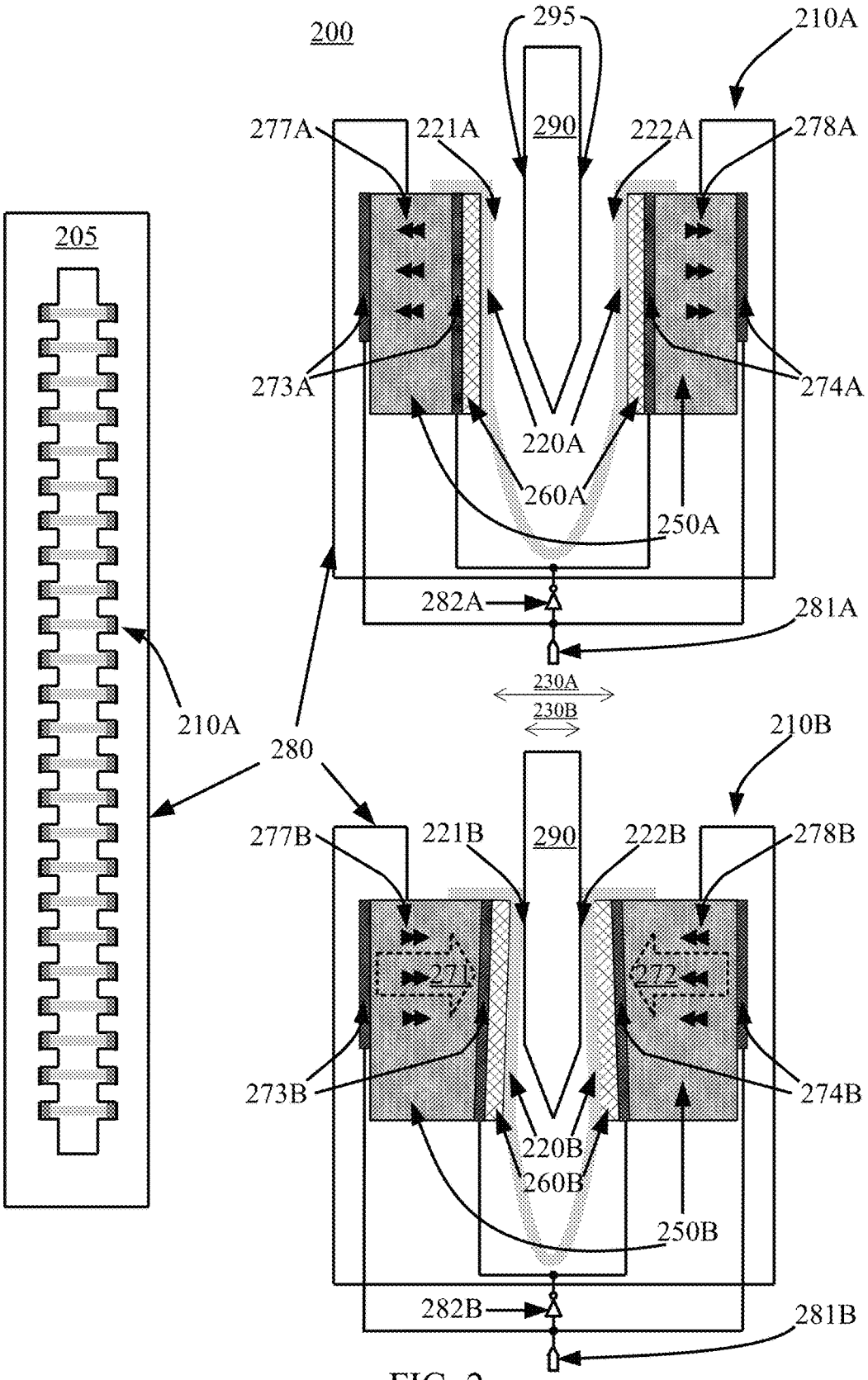
FIG. 2 is a diagrammatic illustration of a card edge connector, according to embodiments.

FIG. 2 is a diagrammatic illustration of a card edge connector 205 from a plurality of viewpoints 200, according to embodiments. The card edge connector 205 may include one or more card edge connector portions as depicted from a top-view (e.g., a view from which a card may be lowered down into the card edge connector 205). As such, a housing 280 may be shown in each of the viewpoints/positions, and may be similar or the same throughout as described herein.

The card edge connector 205 may have a first position (depicted, for example, as 210A) and a second position (depicted, for example, as 210B). The positions (e.g., 210A) may be shown as a cut-out perspective of the card edge connector 205 in FIG. 2. The apparatus may include a set of contacts (220A in the first position, 220B in the second position). The set of contacts may include material such as copper, gold, nickel-plated gold, or the like. In embodiments, the set of contacts may include a set of (metal) pins. Accordingly, the set of pins may be bent, distorted, deformed, contorted, or twisted in the second position relative to the first position (e.g., a similar but different shape).

The set of contacts 220A/220B may be included to connect with a set of card edges 295 of a card 290 (e.g., Peripheral Component Interconnect card, video card, sound card) in the second position 210B. Such connection may occur at both a first contact location 221 (221A/221B) and a second contact location 222 (222A/222B). A first distance (230A) between the first (221A) and second (222A) contact locations in the first position (210A) can exceed a second distance (230B) between the first (221B) and second (222B) contact locations in the second position (210B).

To adjust, move, or orient the set of contacts between the first position and the second position (e.g., from the first position to the second position), the apparatus may include a set of electroactive polymers 250 (250A/250B). In embodiments, a voltage can cause the set of electroactive polymers to adjust the set of contacts between the first position and the second position (e.g., depicted as forces 271 and 272). For example, a control signal 281 (281A/281B) may be "1" or "0" and an inversion of the control signal using an inverter 282 (282A/282B) are connected to electrodes 273/274 (273A/274A/273B/274B). The control signal and the inversion of the control signal are on opposite sides of the electroactive polymer which they touch. The set of electrodes 273/274 may be attached to the set of electroactive polymers 250 to provide a voltage difference across at least a portion of the set of electroactive polymers 250. For example, if a control voltage and an inverter supply voltage are each two volts, then two volts will result in an electric field 277/278 (277A/278A/277B/278B) across the electroactive polymer in one of the directions between the electrodes. In certain embodiments, a set of voltages may be applied at a plurality of locations (e.g., multiple different points/heights of the electroactive polymer). In embodiments, an individual electroactive polymer may be utilized to control an individual contact. In certain embodiments, a plurality of electroactive polymers may be utilized to control a single contact.

In embodiments, as depicted in the plurality of viewpoints 200, the set of electroactive polymers 250 may be located internal to the housing 280. In embodiments, the set of electroactive polymers may include a set of dielectric electroactive polymers. For example, the set of electroactive polymers can be selected from a group consisting of at least one of: a ferroelectric polymer, polyvinylidene fluoride, an electrostrictive graft polymer, or a liquid crystalline polymer. In embodiments, the set of electroactive polymers may include a set of ionic electroactive polymers. For example, the set of electroactive polymers can be selected from a group consisting of at least one of: an ionic polymer-metal composite, an electrorheological fluid, or a stimuli-responsive gel.

In various embodiments, a set of insulators 260 (260A/260B) may be located between the set of contacts and the set of electroactive polymers. In response to an event (e.g., introducing/changing voltage), the set of insulators 260 can remain in contact with the set of electroactive polymers 250. The set of insulators (e.g., one or more electrical insulators) may include plastic/rubber. In certain embodiments, Mylar may be utilized.

Figure 3:
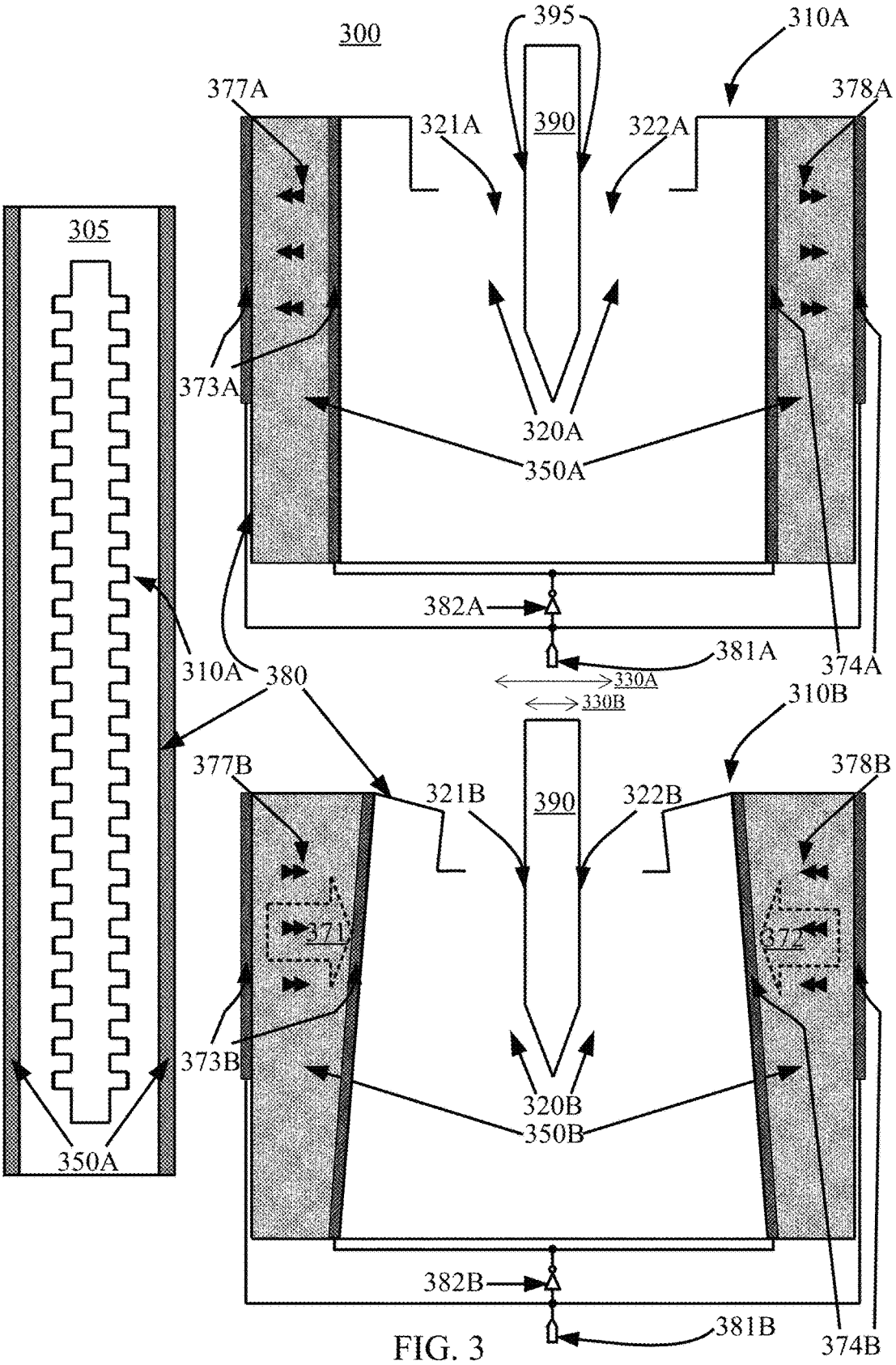
FIG. 3 is a diagrammatic illustration of a card edge connector, according to embodiments.

FIG. 3 is a diagrammatic illustration of a card edge connector 305 from a plurality of viewpoints 300, according to embodiments. The card edge connector 305 may include one or more card edge connector portions as depicted from a top-view (e.g., a view from which a card may be lowered down into the card edge connector 305). As such, a housing 380 may be shown in each of the viewpoints/positions, and may be similar or the same throughout as described herein.

The card edge connector 305 may have a first position (depicted, for example, as 310A) and a second position (depicted, for example, as 310B). The positions (e.g., 310A) may be shown as a cut-out perspective of the card edge connector 305 in FIG. 3. The apparatus may include a set of contacts (320A in the first position, 320B in the second position). In embodiments, the set of contacts may include a set of (metal) pins. Accordingly, the set of pins may be bent, distorted, deformed, contorted, or twisted in the second position relative to the first position (e.g., a similar but different shape).

The set of contacts 320A/320B may be included to connect with a set of card edges 395 of a card 390 (e.g., Peripheral Component Interconnect card, video card, sound card) in the second position 310B. Such connection may occur at both a first contact location 321 (321A/321B) and a second contact location 322 (322A/322B). A first distance (330A) between the first (321A) and second (322A) contact locations in the first position (310A) can exceed a second distance (330B) between the first (321B) and second (322B) contact locations in the second position (310B).

To adjust, move, or orient the set of contacts between the first position and the second position (e.g., from the first position to the second position), the apparatus may include a set of electroactive polymers 350 (350A/350B). In embodiments, a voltage can cause the set of electroactive polymers to adjust the set of contacts between the first position and the second position (e.g., depicted as forces 371 and 372). For example, a control signal 381 (381A/381B) may be "1" or "0" and an inversion of the control signal using an inverter 382 (382A/382B) are connected to electrodes 373/374 (373A/374A/373B/374B). The control signal and the inversion of the control signal are on opposite sides of the electroactive polymer which they touch. The set of electrodes 373/374 may be attached to the set of electroactive polymers 350 to provide a voltage difference across at least a portion of the set of electroactive polymers 350. For example, if a control voltage and an inverter supply voltage are each two volts, then two volts will result in an electric field 377/378 (377A/378A/377B/378B) across the electroactive polymer in one of the directions between the electrodes. In certain embodiments, a set of voltages may be applied at a plurality of locations (e.g., multiple different points/heights of the electroactive polymer). In embodiments, as depicted in the plurality of viewpoints 300, the set of electroactive polymers 350 may be located external to the housing 380. In certain embodiments due to forces 371/372, the shape of the electroactive polymers 350B in the second position 310B may appear as an arc (e.g., space in the middle/center between the housing 380 and electroactive polymer but attached on the top/bottom).

In various embodiments, a user may input a target electroactive polymer voltage (e.g., the voltage that the user wishes to apply to the set of electroactive polymers) into a computer system. The computer system may then determine (e.g., measure) the actual electroactive polymer voltage (e.g., the voltage that is currently being applied to the set of electroactive polymers). The computer system may compare the target electroactive polymer voltage to the actual electroactive polymer voltage to determine whether the electronic component is in the correct/desired position (e.g., the second position). In some embodiments, the computer system may determine that the electronic component is in the correct position if the difference between the actual electroactive polymer voltage and the target electroactive polymer voltage is within a threshold (e.g., within 10%, within a user-defined percentage). If the computer system determines that the electronic component is not in the correct position, the computer system may adjust the voltage applied to the set of electroactive polymers.

In certain embodiments, the set of electroactive polymers may be related to an electrical connector. The set of electroactive polymers may work in conjunction with the connector housing such that the set of electroactive polymers are configured to adjust the position of the electrical connector (and/or the electronic component attached to the connector) relative to a complementary electrical connector or electronic component. For example, the walls of the connector body of an electrical connector may compress as a voltage is applied to set of electroactive polymers in the connector body. The walls may compress in a direction towards a complementary electrical connector. The compressing walls may cause the electrical connector to gain its electrical coupling with the complementary electrical connector. When the voltage is removed from the set of electroactive polymers, the walls may expand, causing the electrical connector and the complementary electrical connector to disconnect.

Figure 4:
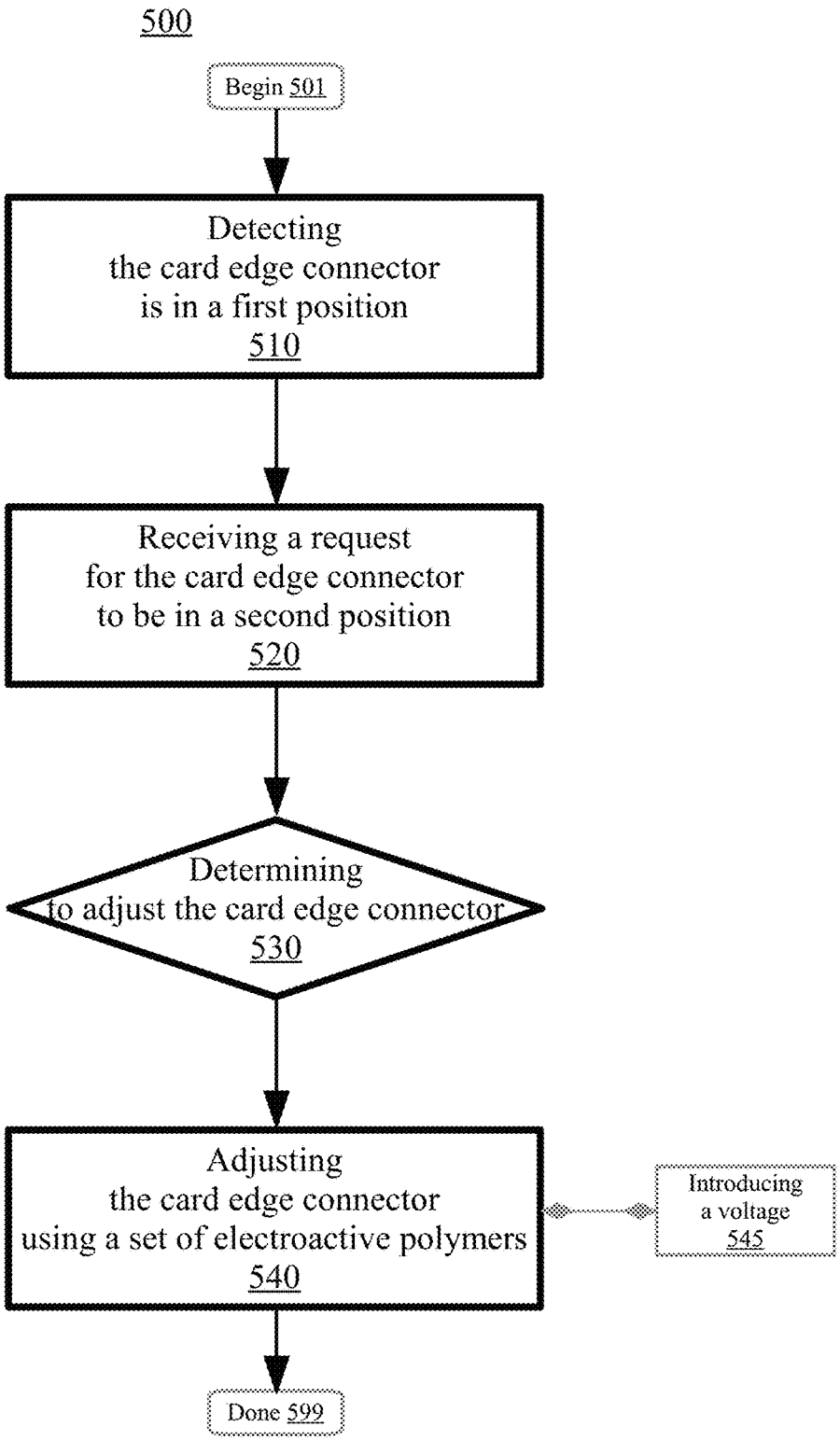
FIG. 4 is a flowchart illustrating a method for managing a card edge connector, according to embodiments.

FIG. 4 is a flowchart illustrating a method 500 for managing a card edge connector, according to embodiments. The method 500 may begin at block 501. At block 510, it is detected (e.g., sensed, identified) that the card edge connector is in a first position. In embodiments, detecting the card edge connector is in the first position includes a set of operations. For example, a voltage being applied to the set of electroactive polymers may be ascertained. The voltage may be compared to a set of predetermined voltages which correspond/correlate to a set of predetermined positions. Based on the comparing, it may be determined that the first position corresponds with a first predetermined position that corresponds/matches with the voltage being applied to the set of electroactive polymers. For example, a first predetermined voltage may correspond to an over-docked shipping position, a second predetermined voltage may correspond to the undocked shipping position, and a third predetermined voltage may correspond to an operating position.

At block 520, a request (e.g., input, message, data packet) is received for the card edge connector to be in a second position (e.g., receiving an input from a user). In embodiments, the first position includes a first predetermined voltage and the second position includes a second predetermined voltage. In embodiments, a set of predetermined positions for selection may be presented to a user. In response, a selection of the second position from the set of predetermined positions can be received from the user. In certain embodiments, it may be detected that a computer system has been powered on. An operating position may be identified by the computer system. The operating position can include a position of the card edge connector that allows the computer system to operate. Accordingly, the operating position may be selected as the second position. In various embodiments, the computer system may automatically determine the second position (e.g., based on the state of the computer). For example, if the computer is powered on, the computer system may determine that the card edge connector needs to be "plugged in" (e.g., connected) to the card for the system to operate properly.

At block 530, a determination is made to adjust the card edge connector. The determination may be made by comparing the first position and the second position (e.g., adjust if they do not match). At block 540, the card edge connector is adjusted using a set of electroactive polymers. The determination may be made again (e.g., adjust until they match). In embodiments, a voltage is introduced or applied at block 545. The voltage can cause the set of electroactive polymers to adjust a set of contacts between the first position and the second position. The method 500 may conclude at block 599. Aspects of method 500 may provide performance or efficiency benefits. In embodiments, a system may combine various aspects such as those described in FIG. 2 and FIG. 4, for example.

Figure 5:
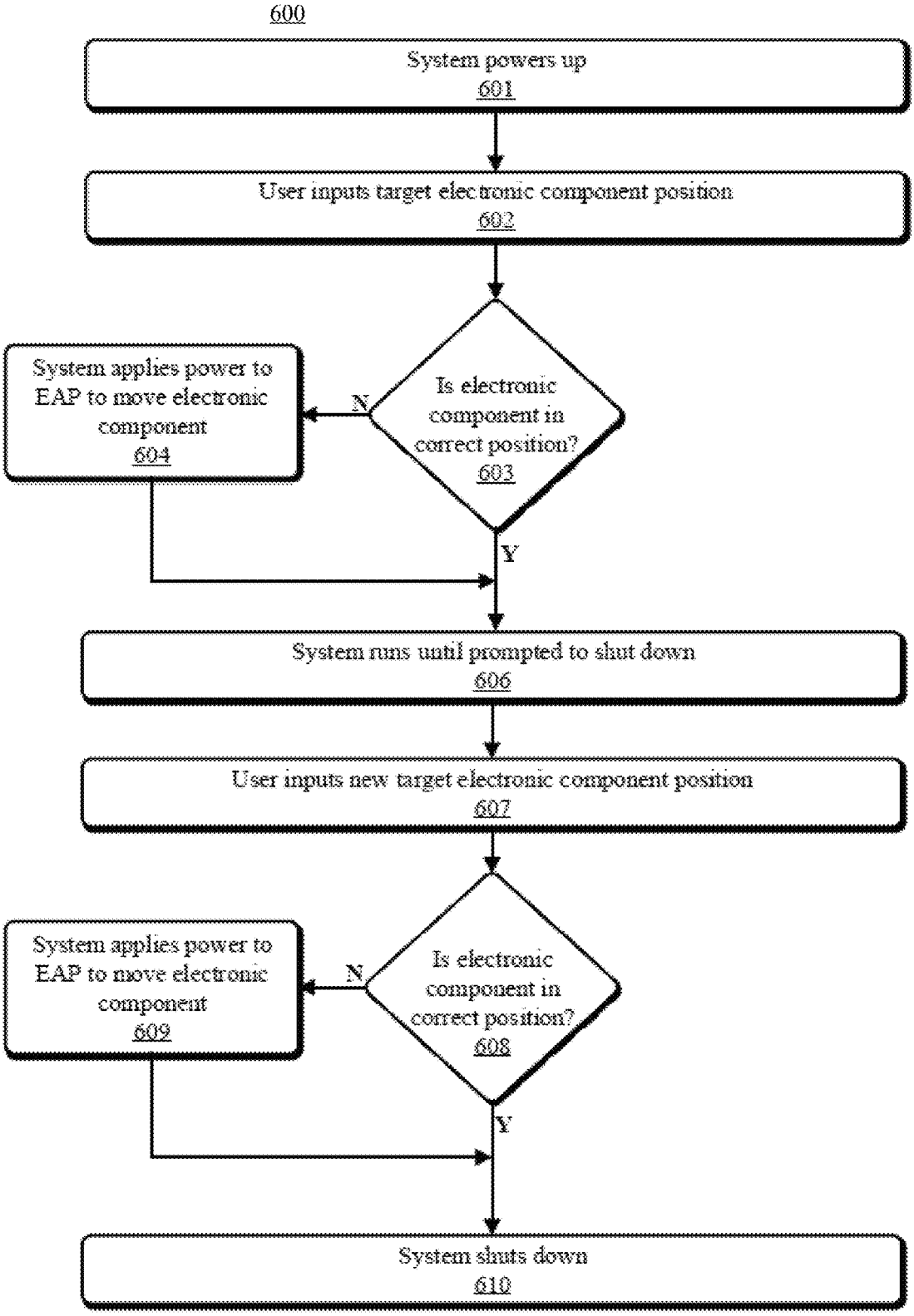
FIG. 5 is a flowchart illustrating a method for managing an electronic component, according to embodiments.

FIG. 5 is a flowchart illustrating a method 600 for managing an electronic component (e.g., card edge connector), according to embodiments. The method 600 may be performed by a computer system with input from a user. The method 600 may begin at operation 601, where the computer system is turned on.

At operation 602, the user may input the target position (e.g., second position) of the electronic component. For example, in certain embodiments the user may select/choose from one or more predetermined positions (e.g., over-docked shipping position, operating position). In various embodiments, the user may input a target voltage that should be applied to the set of electroactive polymers.

After the user inputs a target position of the electronic component at operation 602, the computer system may determine whether the electronic component is in the correct position (e.g., the target position) at decision block 603. The computer system may compare the current position (e.g., first position) of the electronic component to the target position. For example, the computer system may compare the current voltage being applied to the set of electroactive polymers to the voltage associated with the target position. If the electronic component is in the correct position, the method 600 may progress to operation 606.

If, however, the electronic component is not in the correct position, the method 600 may progress to operation 604, where the computer system may apply a voltage to the set of electroactive polymers. The applied voltage may correspond to the target position. After the computer system applies the voltage to the set of electroactive polymers, causing the electronic component to move into the target position, the system may run until prompted to shut down at operation 606.

After the computer system is prompted to shut down at operation 606, the user may input a new target position for the electronic component at operation 607. In some embodiments, the user may select from one or more predetermined positions (e.g., over-docked shipping position, operating position). For example, if the computer system is being shipped to a recipient, the user may select a shipping position during the shutdown procedure. If, however, the computer system is not going to be shipped, the user may select the operating position during the shutdown procedure. In certain embodiments, the user may input a target voltage that should be applied to the set of electroactive polymers instead of selecting from a list of predetermined positions.

After the user inputs a new target position of the electronic component at operation 607, the computer system may determine whether the electronic component is in the correct position (e.g., the new target position) at decision block 608. The computer system may compare the current position of the electronic component to the new target position. For example, the computer system may compare the current voltage being applied to the set of electroactive polymers to the voltage corresponding to the new target position. If the electronic component is in the correct position, the computer system may complete the shutdown process at operation 610 and the method 600 may end.

If, however, the electronic component is not in the correct position, the computer system may apply a voltage to the set of electroactive polymers to move the electronic component into the new target position at operation 609. After the computer system applies the voltage to the set of electroactive polymers, causing the electronic component to move into the new target position, the system may complete the shutdown process at operation 610 and the method 600 may end.

In addition to embodiments described above, other embodiments having fewer operational steps, more operational steps, or different operational steps are contemplated. Also, some embodiments may perform some or all of the above operational steps in a different order. The modules are listed and described illustratively according to an embodiment and are not meant to indicate necessity of a particular module or exclusivity of other potential modules (or functions/purposes as applied to a specific module).

In the foregoing, reference is made to various embodiments. It should be understood, however, that this disclosure is not limited to the specifically described embodiments. Instead, any combination of the described features and elements, whether related to different embodiments or not, is contemplated to implement and practice this disclosure. Many modifications and variations may be apparent to those of ordinary skill in the art without departing from the scope and spirit of the described embodiments. Furthermore, although embodiments of this disclosure may achieve advantages over other possible solutions or over the prior art, whether or not a particular advantage is achieved by a given embodiment is not limiting of this disclosure. Thus, the described aspects, features, embodiments, and advantages are merely illustrative and are not considered elements or limitations of the appended claims except where explicitly recited in a claim(s).

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

Embodiments according to this disclosure may be provided to end-users through a cloud-computing infrastructure. Cloud computing generally refers to the provision of scalable computing resources as a service over a network. More formally, cloud computing may be defined as a computing capability that provides an abstraction between the computing resource and its underlying technical architecture (e.g., servers, storage, networks), enabling convenient, on-demand network access to a shared pool of configurable computing resources that can be rapidly provisioned and released with minimal management effort or service provider interaction. Thus, cloud computing allows a user to access virtual computing resources (e.g., storage, data, applications, and even complete virtualized computing systems) in "the cloud," without regard for the underlying physical systems (or locations of those systems) used to provide the computing resources.

Typically, cloud-computing resources are provided to a user on a pay-per-use basis, where users are charged only for the computing resources actually used (e.g., an amount of storage space used by a user or a number of virtualized systems instantiated by the user). A user can access any of the resources that reside in the cloud at any time, and from anywhere across the Internet. In context of the present disclosure, a user may access applications or related data available in the cloud. For example, the nodes used to create a stream computing application may be virtual machines hosted by a cloud service provider. Doing so allows a user to access this information from any computing system attached to a network connected to the cloud (e.g., the Internet).

Embodiments of the present disclosure may also be delivered as part of a service engagement with a client corporation, nonprofit organization, government entity, internal organizational structure, or the like. These embodiments may include configuring a computer system to perform, and deploying software, hardware, and web services that implement, some or all of the methods described herein. These embodiments may also include analyzing the client's operations, creating recommendations responsive to the analysis, building systems that implement portions of the recommendations, integrating the systems into existing processes and infrastructure, metering use of the systems, allocating expenses to users of the systems, and billing for use of the systems.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the foregoing is directed to exemplary embodiments, other and further embodiments of the invention may be devised without departing from the basic scope thereof, and the scope thereof is determined by the claims that follow. The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. An apparatus comprising:

a card edge connector having a first position and a second position;

a set of contacts to connect with a set of card edges in the second position at both a first contact location and a second contact location, wherein a first distance between the first and second contact locations in the first position exceeds a second distance between the first and second contact locations in the second position; and a set of electroactive polymers to adjust the set of contacts between the first position and the second position, wherein a voltage causes the set of electroactive polymers to adjust the set of contacts between the first position and the second position.

2. The apparatus of claim 1, further comprising:

a set of insulators located between the set of contacts and the set of electroactive polymers.

3. The apparatus of claim 1, wherein the set of contacts includes a set of pins which are bent in the second position relative to the first position.

4. The apparatus of claim 1, wherein the set of electroactive polymers is located internal to a housing.

5. The apparatus of claim 1, wherein the set of electroactive polymers is located external to a housing.

6. The apparatus of claim 1, wherein the set of electroactive polymers is a set of dielectric electroactive polymers.

7. The apparatus of claim 6, wherein the set of electroactive polymers is selected from a group consisting of: a ferroelectric polymer, polyvinylidene fluoride, an electrostrictive graft polymer, and a liquid crystalline polymer.

8. The apparatus of claim 1, wherein the set of electroactive polymers is a set of ionic electroactive polymers.

9. The apparatus of claim 8, wherein the set of electroactive polymers is selected from a group consisting of: an ionic polymer-metal composite, an electrorheological fluid, and a stimuli-responsive gel.

* * * * *